US008986075B2

(12) United States Patent
Franzen

(10) Patent No.: US 8,986,075 B2
(45) Date of Patent: Mar. 24, 2015

(54) BLADE GRINDER COMPRISING A BLADE HOLDER

(75) Inventor: Johannes Franzen, Mechernich-Holzheim (DE)

(73) Assignee: Johannes Franzen GmbH & Co. KG, Mechernich-Holzheim (DE)

( * ) Notice: Subject to any disclaimer, the term of this patent is extended or adjusted under 35 U.S.C. 154(b) by 85 days.

(21) Appl. No.: 13/814,951

(22) PCT Filed: Aug. 3, 2011

(86) PCT No.: PCT/DE2011/001544

§ 371 (c)(1), (2), (4) Date: Feb. 8, 2013

(87) PCT Pub. No.: WO2012/025089

PCT Pub. Date: Mar. 1, 2012

(65) Prior Publication Data

US 2013/0157547 A1 Jun. 20, 2013

(30) Foreign Application Priority Data

Aug. 11, 2010 (DE) ..... 10 2010 034 048

(51) Int. Cl.
*B24B 3/36* (2006.01)
*B24B 41/06* (2012.01)

(52) U.S. Cl.
CPC . *B24B 3/36* (2013.01); *B24B 3/365* (2013.01); *B24B 41/066* (2013.01)
USPC ..... 451/177; 451/232; 451/234; 451/380; 451/398

(58) Field of Classification Search
CPC ..... B24B 3/36; B24B 3/365; B24B 41/06
USPC ..... 451/177, 232, 234, 380, 398
See application file for complete search history.

(56) References Cited

U.S. PATENT DOCUMENTS

| | | | | |
|---|---|---|---|---|
| 828,853 | A * | 8/1906 | Ives | 451/321 |
| 883,019 | A * | 3/1908 | Henry | 451/321 |
| 981,810 | A * | 1/1911 | Sterling | 125/11.03 |
| 2,165,929 | A * | 7/1939 | Lentz | 451/320 |
| 4,502,457 | A * | 3/1985 | Marron | 125/11.14 |
| 4,841,678 | A * | 6/1989 | Thomas | 451/376 |
| 4,936,053 | A * | 6/1990 | Shanelec | 451/224 |
| 5,331,774 | A * | 7/1994 | Domenella | 451/45 |
| 5,547,419 | A * | 8/1996 | Hulnicki | 451/321 |
| 6,471,569 | B1 * | 10/2002 | Bernhard | 451/224 |
| 7,967,666 | B1 * | 6/2011 | Messner | 451/349 |
| 2004/0142645 | A1 * | 7/2004 | Maus, Jr. | 451/124 |
| 2007/0249269 | A1 * | 10/2007 | Swartz | 451/367 |
| 2007/0281594 | A1 * | 12/2007 | Jones et al. | 451/367 |
| 2008/0096477 | A1 * | 4/2008 | Lytinas | 451/349 |
| 2010/0203808 | A1 * | 8/2010 | Hout et al. | 451/28 |

FOREIGN PATENT DOCUMENTS

DE 10 2008 058550 5/2009

OTHER PUBLICATIONS

International Search Report of PCT/DE2011/001544, date of mailing Mar. 19, 2012.

* cited by examiner

*Primary Examiner* — George Nguyen
(74) *Attorney, Agent, or Firm* — Collard & Roe, P.C.

(57) ABSTRACT

Disclosed is a blade grinder comprising a blade holder that is mounted so as to be rotatable about a horizontal shaft which is mounted so as to be rotatable about a vertical axis, thus allowing the blade to be optimally adjusted relative to a grinding disk. The grinding disk can preferably be vertically and horizontally moved using spindles. This creates a simple design allowing a lawnmower blade to be ground in a fully automatic manner.

9 Claims, 1 Drawing Sheet

BLADE GRINDER COMPRISING A BLADE HOLDER

CROSS REFERENCE TO RELATED APPLICATIONS

This application is the National Stage of PCT/DE2011/001544 filed on Aug. 3, 2011, which claims priority under 35 U.S.C. §119 of German Application No, 10 2010 034 048.0 filed on Aug. 11, 2010, the disclosure of which is incorporated by reference. The international application under POT article 21(2) was not published in English.

BACKGROUND OF THE INVENTION

1. Field of the Invention

The invention relates to a blade grinder with a blade holder.

2. The Prior Art

In order to grind a blade, a blade is usually guided along a grindstone. Automating blade grinding devices enable a highly precise grinding process. However, difficulties arise for automatic operation if the blades exhibit special contours requiring that the grinding wheel be specially guided relative to the blade.

Many blades, for example lawnmower blades, have opposing cutting edges. In order to precisely grind such blades, they have to be chucked. In a chucked position, one side of the blade is here grinded first. The blade is then turned and again chucked, so that the second side of the blade can be grinded.

In particular in curved blades, there is no straight cutting edge, with the cutting blade of the blade instead being shaped differently radially inward than radially outward. Such blades cannot be automatically machined with conventional blade grinders.

SUMMARY OF THE INVENTION

Therefore, the object of the invention is to further develop a blade grinder with a blade holder in such a way that blades with a complicated cutting edge contour can also be grinded with a simple blade grinder.

This object is achieved by means of a blade grinder with a blade holder in which the blade holder is mounted so that it can rotate around a first axis, wherein the first axis is mounted so that it can rotate around a second axis arranged perpendicular to the first axis.

This special mounting of the blade holder makes it possible to quickly and precisely grind blades with two opposing cutting edges. The grindstone can move within narrow limits. This saves on time that would otherwise be required to move the grindstone. By rotating the blade holder around a perpendicular axis, the other cutting edge of the two-edged blade can be grinded after the one side has been grinded. Rotating the blade holder around a horizontal axis makes it easy to adjust the pitch of the blade relative to the grindstone, and also to vary it as needed during the grinding process.

As a consequence, the special mounting of the blade enables a simple machine structure, the grinding of individually configured cutting edges, and a particularly rapid grinding process.

It is advantageous for the blade grinder to exhibit a grindstone that can be moved along a first line and along a second line arranged perpendicular to the first line. While the blade holder can be rotated around two axes arranged perpendicular to each other, the grindstone can be moved along two lines arranged perpendicular to each other. This enables a simple machine structure, in which the grindstone preferably can be moved along a perpendicular line and along a horizontal line. The interaction between the rotational movements on the blade holder and lateral shifts on the grindstone makes it possible to quickly and precisely grind a wide variety of blades.

It is advantageous for the first axis to intersect the second axis. This permits a simple structure for the blade holder.

It is further proposed that the second axis be parallel to the first line. It is also advantageous for the first axis to run parallel to the second line. This simplifies the structure, since all lines and axes can be made either horizontal or perpendicular in design as a result, for example.

It is advantageous for the blade holder to be arranged concentrically to the second, preferably perpendicularly arranged axis. A simple structure is obtained by arranging the blade holder eccentrically to the first, preferably horizontal axis. This makes it possible to arrange the motor for the horizontal axis under the blade holder, and provide the motor for the perpendicular axis under the motor for the horizontal axis.

In order to be able to turn the blade holder as effortlessly as possible around the first axis, it is proposed that the side of the first axis opposite the blade holder exhibit a weight that turns with the axis.

This weight is adjusted to the weight of the blade holder with the bale, so that the torque exerted by the blade holder with the blade on the axis is essentially cancelled out by the torque exerted on the axis by the weight. As a result, a simple motor is sufficient for pivoting the horizontal axis with the blade holder attached thereto.

Turning the blade holder around the second, preferably perpendicular axis complicates the cable routing to the motor turning the horizontal axis. It is therefore proposed that the blade holder can only be turned around the second axis by less than 360 degrees.

A simple structure for the blade grinder is achieved by having the first line along which the grindstone is moved be horizontal.

A high precision and rapid feed rate is achieved by being able to move the grindstone horizontally with a first spindle, and perpendicularly with a second spindle.

A preferred embodiment provides that the blade holder be designed as a scale. In this way, the blade holder makes it possible to check whether the blade secured to it weighs the same on both sides. If the blade is heavier on one side than on the other side, this difference can be offset during the grinding process. As a result, the blade can be balanced out during the grinding process.

BRIEF DESCRIPTION OF THE DRAWINGS

A preferred embodiment for a blade grinder is shown in the drawing, and will be explained in greater detail below. Shown on.

DETAILED DESCRIPTION OF THE DRAWINGS

Figure 1:
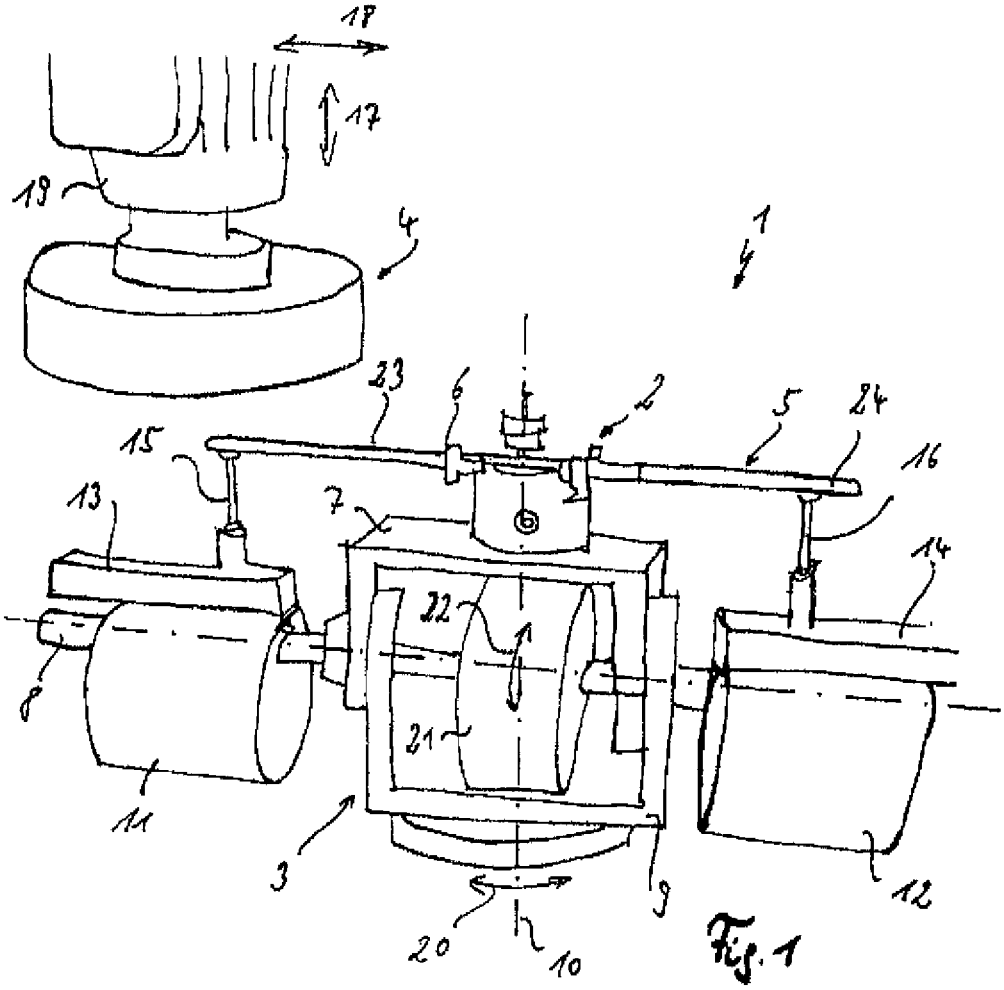
FIG. 1 is a schematic view of a blade grinder with blade holder and grindstone.
Figure 2:
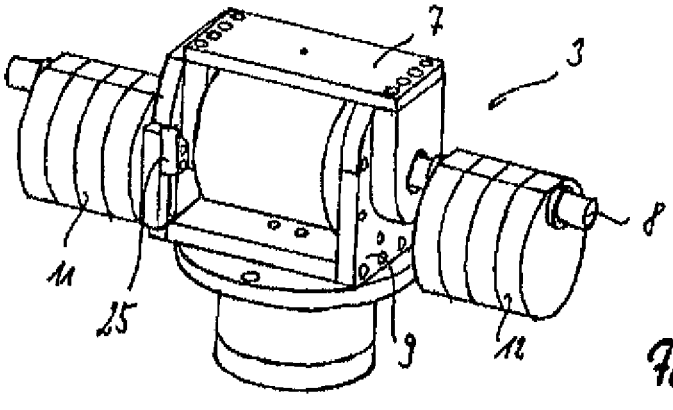
FIG. 2 is a detailed view of the rotatable mounting for the blade holder.

The blade grinder 1 depicted on FIG. 1 essentially consists of the blade holder 2, the blade holder mount 3 and the grindstone 4.

A blade 5 with the blade holder 2 is clamped into a chuck 6, and in so doing held fast on the blade holder mount 3. The blade holder mount 3 consists of a retaining table 7, which is secured to a first axis 8. The axis 8 is rotatably mounted in a rack 9. This rack 9 is in turn mounted so that it can rotate around a second axis 10.

Weights 11, 12 are attached to the first axis 8 in such a way that the weights rotate with the axis 8. Secured to the weights 11 and 12 are brackets 13 and 14, which have attached to them vertically adjustable devices 15, 16 for supporting the blade 5.

The grindstone 4 is moved up and down along a perpendicular line 17 via a first spindle (not shown). A second spindle (not shown) makes it possible to shift the grindstone 4 along a horizontal second line 18. As a result, the motor 19 of the grindstone 4 can be precisely moved up and down and back and forth.

The blade holder mount 3 is first rotated by means of a motor (not shown) around the axis 10 according to arrow 20 in such a way that the blade lies roughly under the grindstone 4. The motor 21 moves the blade holder 2 along arrow direction 22 around the first axis 8 in such a way as that the blade 5 is aligned in an optimal position inclined relative to the grindstone 4. The grindstone 4 can then be lowered and horizontally shifted with the spindle, so that it traverses the edge of the blade 5. Moving the grindstone 4 back and forth on the cutting edge of the blade 5 grinds the first side 23 of the blade 5.

As soon as the first side 23 of the blade 5 has been grinded, the blade 5 is turned around the axis 10 in such a way that the second side 24 of the blade 5 is positioned roughly under the grindstone 4. The motor 21 is in turn used to adjust the inclined position of the blade 5 relative to the grindstone 4 before the grindstone 4 is lowered and moved back and forth on the cutting edge of the blade 5.

A vertically adjustable abutment 25 serves as an abutment for the table 7 in a special angular position of the table 7 relative to the rack 9.

The blade grinder makes it possible to move the blade and grindstone by remote control. Because there are few prescribed possible motions, a simple device can be used to grind a wide variety of blades.

Programming sequences of movement makes it possible to keep special movement sequences as a software program for special blades. After a blade 5 has been chucked, a prescribed software program that suits the blade 5 can be used to fully automate the control of the entire sequence of movements by the blade holder and grindstone. This leads to rapid, efficient and especially high-quality blade grinding.

The invention claimed is:

1. A blade grinder with a blade holder, wherein the blade holder is mounted so that it can rotate around a first axis, wherein the first axis is mounted so that it can rotate around a second axis arranged perpendicular to the first axis, and wherein the blade holder is designed as a scale.

2. The blade grinder according to claim 1, wherein it exhibits a grindstone, which can be moved along a first line and along a second line arranged perpendicular to the first line.

3. The blade grinder according to claim 1, wherein the first axis intersects the second axis.

4. The blade grinder according to claim 2, wherein the second axis is parallel to the first line.

5. The blade grinder according to claim 1, wherein the blade holder is arranged eccentrically to the first axis.

6. The blade grinder according to claim 1, wherein the side of the first axis opposite the blade holder exhibits a weight that turns with the first axis.

7. The blade grinder according to claim 1, wherein the blade holder can be turned around the second axis by less than 360°.

8. The blade grinder according to claim 2, wherein the first line is horizontal.

9. The blade grinder according to claim 2, wherein the grindstone can be moved horizontally with a first spindle, and perpendicularly with a second spindle.

* * * * *